US005366051A

United States Patent [19]

Bartnicki et al.

[11] Patent Number: 5,366,051

[45] Date of Patent: * Nov. 22, 1994

[54] HOLLOW PLASTIC LADDER

[75] Inventors: Frederick J. Bartnicki, Greenville; Robert Beggs, Fredonia, both of Pa.

[73] Assignee: R. D. Werner Co., Inc., Greenville, Pa.

[ * ] Notice: The portion of the term of this patent subsequent to Jul. 21, 2009 has been disclaimed.

[21] Appl. No.: 875,354

[22] Filed: Apr. 29, 1992

Related U.S. Application Data

[63] Continuation of Ser. No. 565,966, Aug. 10, 1990, Pat. No. 5,131,495.

[51] Int. Cl.[5] ..... E06C 7/00

[52] U.S. Cl. ..... 182/46; 182/124

[58] Field of Search ..... 182/46, 174, 173, 124

[56] References Cited

U.S. PATENT DOCUMENTS

| | | | |
|---|---|---|---|
| 4,187,928 | 2/1980 | Larson | 182/173 X |
| 4,332,308 | 6/1982 | Larson | 182/124 X |
| 4,376,470 | 3/1983 | Ashton | 182/46 X |
| 4,834,216 | 5/1989 | Wallick, Jr. et al. | 182/46 X |
| 4,842,098 | 6/1989 | Yuen | 182/46 X |
| 5,131,495 | 7/1992 | Bartnicki et al. | 182/46 X |

*Primary Examiner*—Blair M. Johnson

*Attorney, Agent, or Firm*—Ansel M. Schwartz

[57] ABSTRACT

The present invention pertains to a ladder. The ladder includes a first plastic side rail, at least a portion of which is hollow. The ladder also includes a second plastic side rail, at least a portion of which is hollow. The second side rail is in parallel with the first side rail. Additionally, the ladder includes a plurality of steps, each of which is attached to the first and second side rails at predetermined locations such that each step forms a flat weight bearing platform upon which a user can stand. The first and second side rails each have a plurality of pockets having solid cross sections disposed therealong at predetermined positions, and each of the steps are attached to the first and second side rails at corresponding pockets therein with fasteners through holes in the solid cross sections. The present invention also pertains to a stepladder. The stepladder includes a first side rail. The stepladder also includes a second side rail adjacent to and in parallel with the first side rail. There are a plurality of steps, each of which is attached to the first and second side rails at predetermined locations such that each step forms a flat weight bearing platform upon which a user can stand. The first and second side rails and the steps form a front section. Additionally, there is a third side rail adjacent to the first section. There is also a fourth side rail adjacent to and in parallel with the third side rail. The stepladder also includes a first bracing element attached to the third and fourth side rails to support them. The third and fourth side rails and first bracing element define a rear section. Moreover, there is a top which is connected to the front and rear sections at the top ends of the first and second rails, and the top ends of the third and fourth rails such that the front and rear sections form a V-shape when deployed and fold on top of each other when undeployed. The stepladder also includes a shelf in pivotal relationship with respect to the front and rear sections such that when the front and rear sections are deployed, the shelf automatically extends essentially perpendicularly with the front and rear sections, and when the front and rear sections are folded on top of each other to be undeployed, the shelf automatically folds into an essentially parallel position with respect to the front and rear sections.

8 Claims, 11 Drawing Sheets

HOLLOW PLASTIC LADDER

This is a continuation of copending application Ser. No. 07/565,966 filed Aug. 10, 1990; now U.S. Pat No. 5,131,495.

FIELD OF THE INVENTION

The present invention relates to ladders. More specifically, the present invention relates to an improved structure of a freestanding ladder.

BACKGROUND OF THE INVENTION

Earlier forms of freestanding ladder structures are commonly made of wood, fiberglass, reinforced plastic or aluminum. Typically, linear pieces of uniform cross section are joined to form a suitable frame. Sometimes, many pieces of material and hardware are needed just to form a single part of the ladder. This labor extensive process can be expensive. A further disadvantage is that an extra manufacturing step is required for each feature such as hooks, nonslip tread, color, graphics and directions.

U.S. Pat. No. 4,023,647 describes a ladder that overcomes some of foregoing deficiencies by providing a freestanding pool ladder that is constructed of plastic and formed by the process of blow molding in this method the entire ladder section of the structure is blow molded as one piece.

Unfortunately, this method provides limited structural rigidity. Thus, reinforcing inserts, such as wood, must be arranged within areas of high stress.

SUMMARY OF THE INVENTION

The present invention pertains to a ladder. The ladder includes a first plastic side rail, at least a portion of which is hollow. The ladder also includes a second plastic side rail, at least a portion of which is hollow. The second side rail is in parallel with the first side rail. Additionally, the ladder includes a plurality of steps, each of which is attached to the first and second side rails at predetermined locations such that each step forms a flat weight bearing platform upon which a user can stand. The first and second side rails each have a plurality of pockets having solid cross sections disposed therealong at predetermined positions, and each of the steps are attached to the first and second side rails at corresponding pockets therein with fasteners through holes in the solid cross sections.

The present invention also pertains to a stepladder. The stepladder includes a first side rail. The stepladder also includes a second side rail adjacent to and in parallel with the first side rail. There are a plurality of steps, each of which is attached to the first and second side rails at predetermined locations such that each step forms a flat weight bearing platform upon which a user can stand. The first and second side rails and the steps form a front section. Additionally, there is a third side rail adjacent to the first section. There is also a fourth side rail adjacent to and in parallel with the third side rail. The stepladder also includes a first bracing element attached to the third and fourth side rails to support them. The third and fourth side rails and first bracing element define a rear section. Moreover, there is a top which is connected to the front and rear sections at the top ends of the first and second rails, and the top ends of the third and fourth rails such that the front and rear sections form a V-shape when deployed and fold on top of each other when undeployed. The stepladder also includes a shelf in pivotal relationship with respect to the front and rear sections such that when the front and rear sections are deployed, the shelf automatically extends essentially perpendicularly with the front and rear sections, and when the front and rear sections are folded on top of each other to be undeployed, the shelf automatically folds into an essentially parallel position with respect to the front and rear sections.

BRIEF DESCRIPTION OF THE DRAWINGS

In the accompanying drawings, the preferred embodiments of the invention and preferred method of practicing the invention are illustrated in which.

DESCRIPTION OF THE PREFERRED EMBODIMENT

Figure 1:
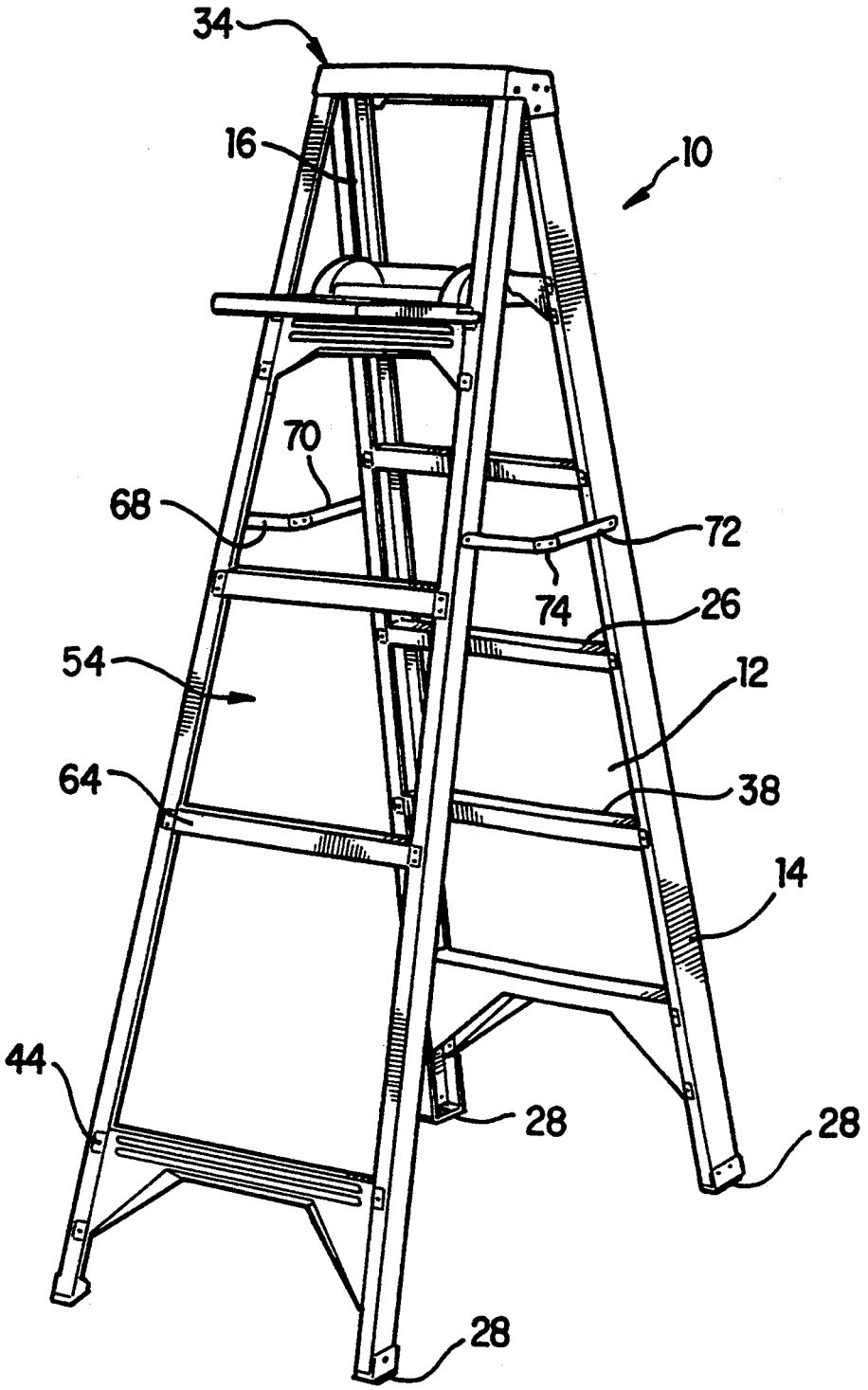
FIG. 1 is a schematic representation showing the ladder unfolded for use.

Referring now to the drawings wherein like reference numerals refer to similar or identical parts throughout the several views, and more specifically to FIG. 1 thereof, there is shown a schematic representation of a ladder 10 to climb or descend vertically. The ladder 10 has a front section 12 which is comprised of two vertically oriented side rails, first left front rail 14 and second right front rail 16, which structurally are mirror images of each other. Hence, for convenience of the reader only the left front rail 14 will be explicitly described, it being appreciated that the same reference numerals will serve to identify the corresponding element or portion of the right front rail 16.

Figure 2A:
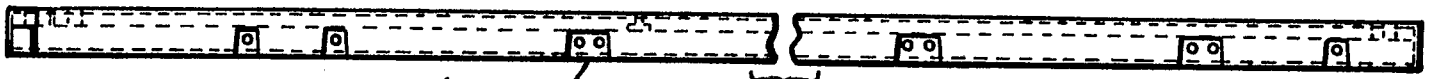
FIGS. 2*a*–2*f* show several views and sections of a blow molded front rail.
Figure 2B:
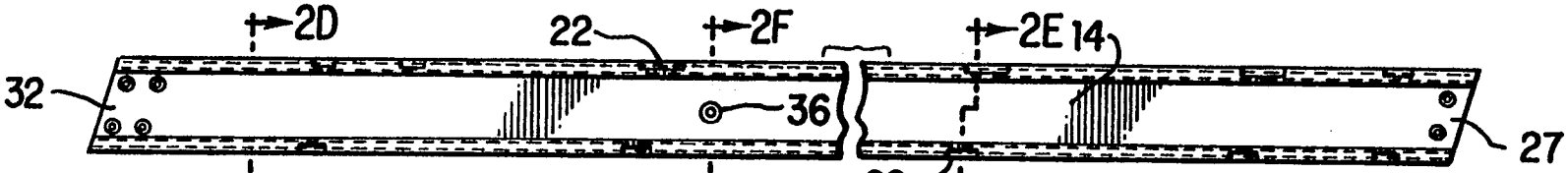
Figure 2C:
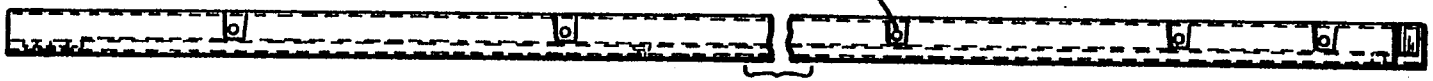
Figure 2F:
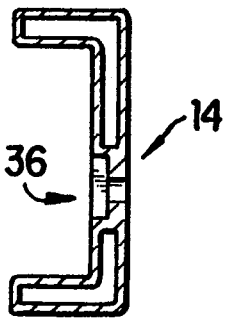
Figure 2E:
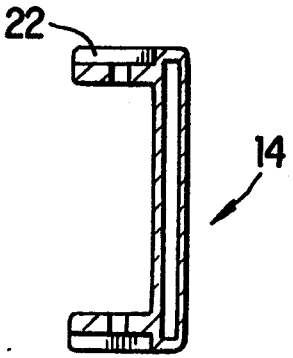
Figure 2D:
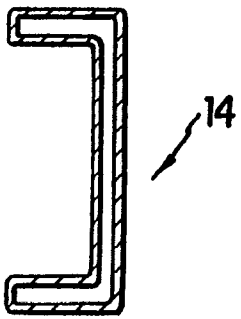
Figure 3A:
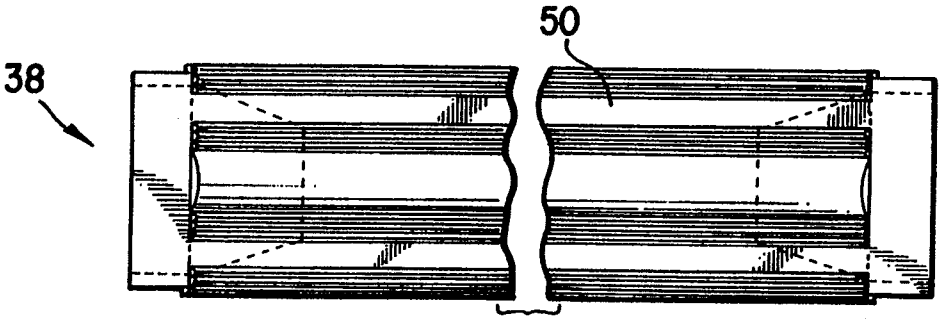
FIGS. 3*a*–3*e* show several views and sections of a blow molded middle step.
Figure 3B:
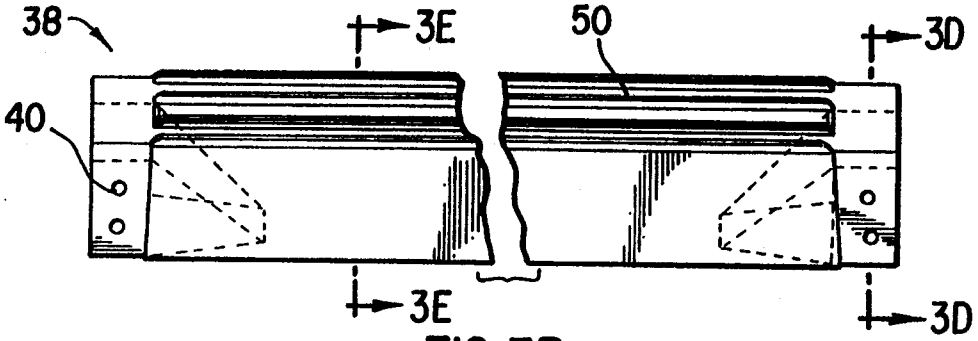
Figure 3E:
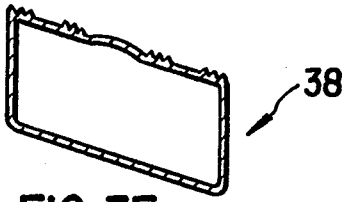
Figure 3C:
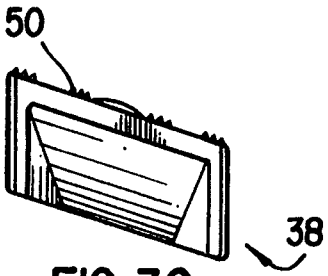
Figure 3D:
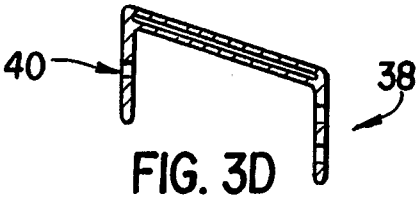
Figure 4A:
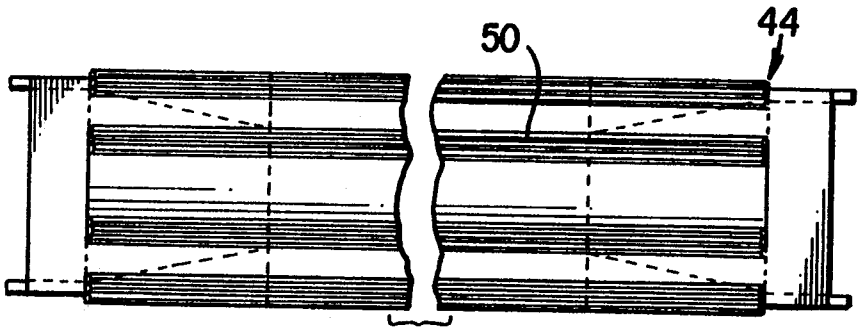
FIGS. 4*a*–4*e* show several views and sections of a blow molded braced step.
Figure 4B:
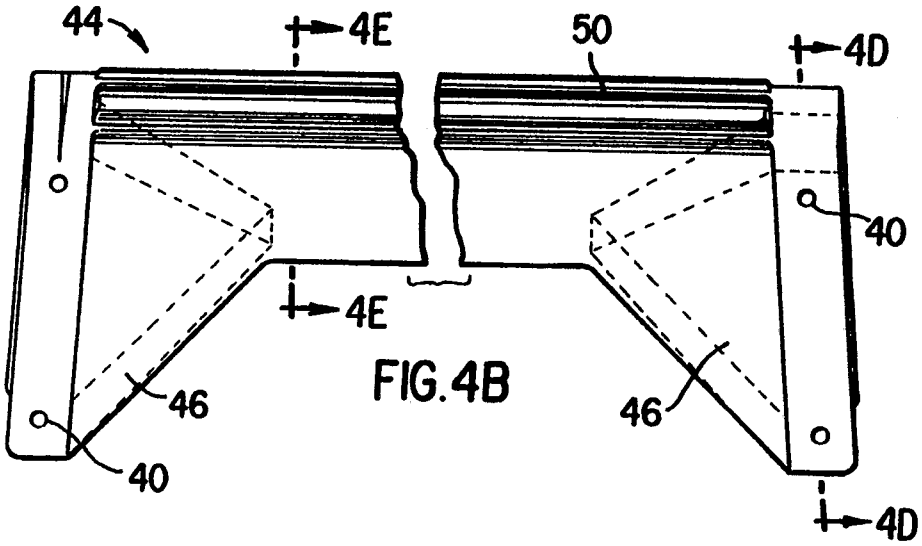
Figure 4D:
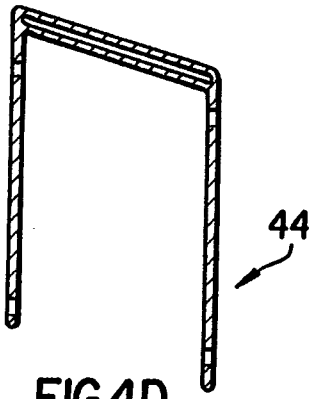
Figure 4C:
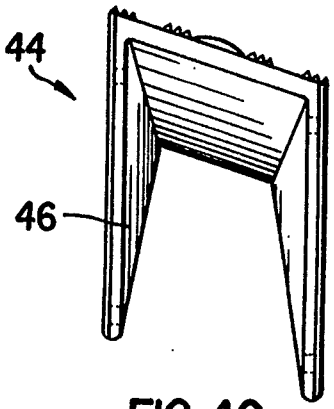
Figure 4E:
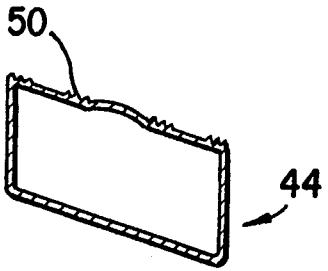
Figure 5A:
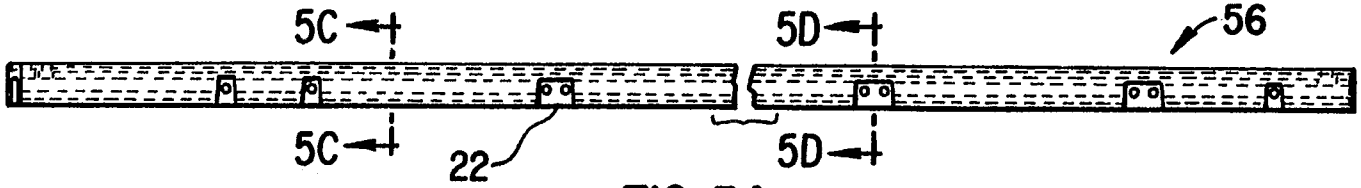
FIGS. 5*a*–5*e* shown several views and sections of a blow molded rear rail.
Figure 5B:
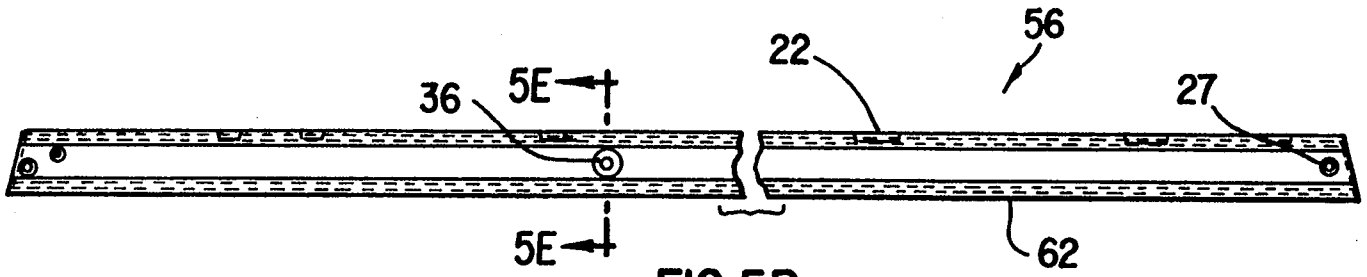
Figure 5E:
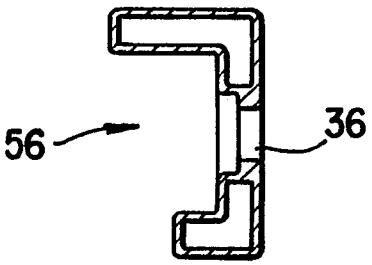
Figure 5D:
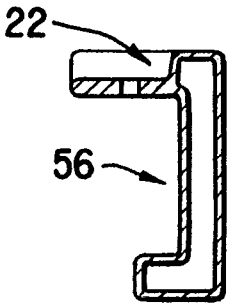
Figure 5C:
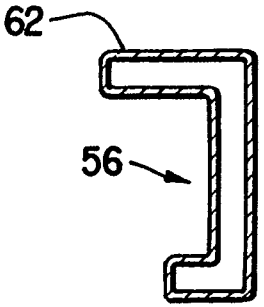
Figure 6E:
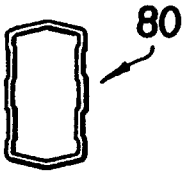
FIGS. 6*a*–6*e* show several views and sections of a blow molded center bracing element.
Figure 6D:
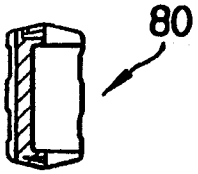
Figure 6B:
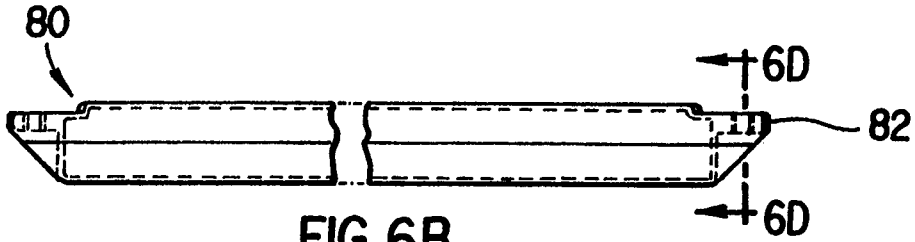
Figure 6A:
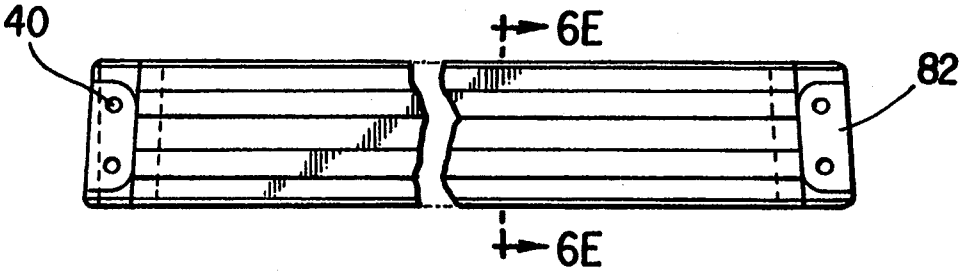
Figure 6C:
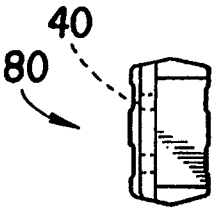
Figure 7D:
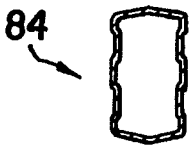
FIGS. 7*a*–7*e* show several views and sections of a blow molded braced bracing element.
Figure 7B:
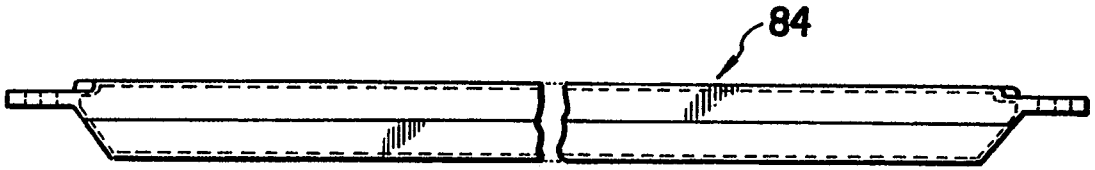
Figure 7A:
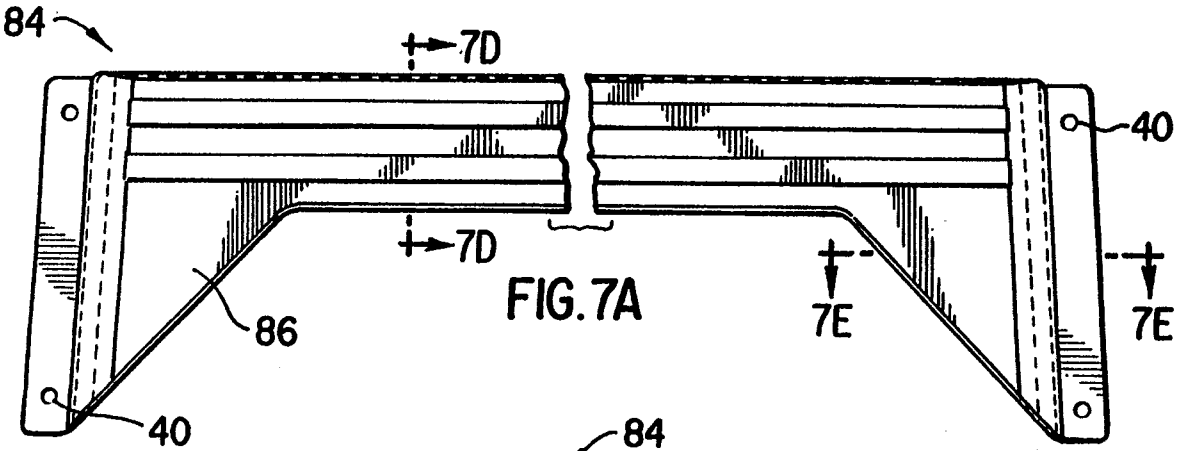
Figure 7E:
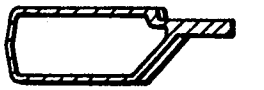
Figure 7C:
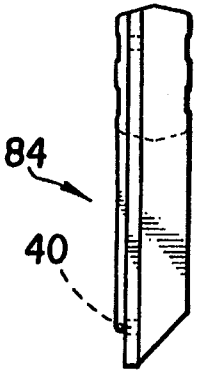
Figure 8D:
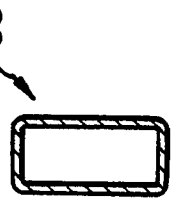
FIGS. 8*a*–8*d* show several views and sections of a blow molded x-shaped brace.
Figure 8C:
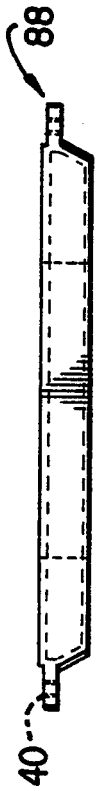
Figure 8A:
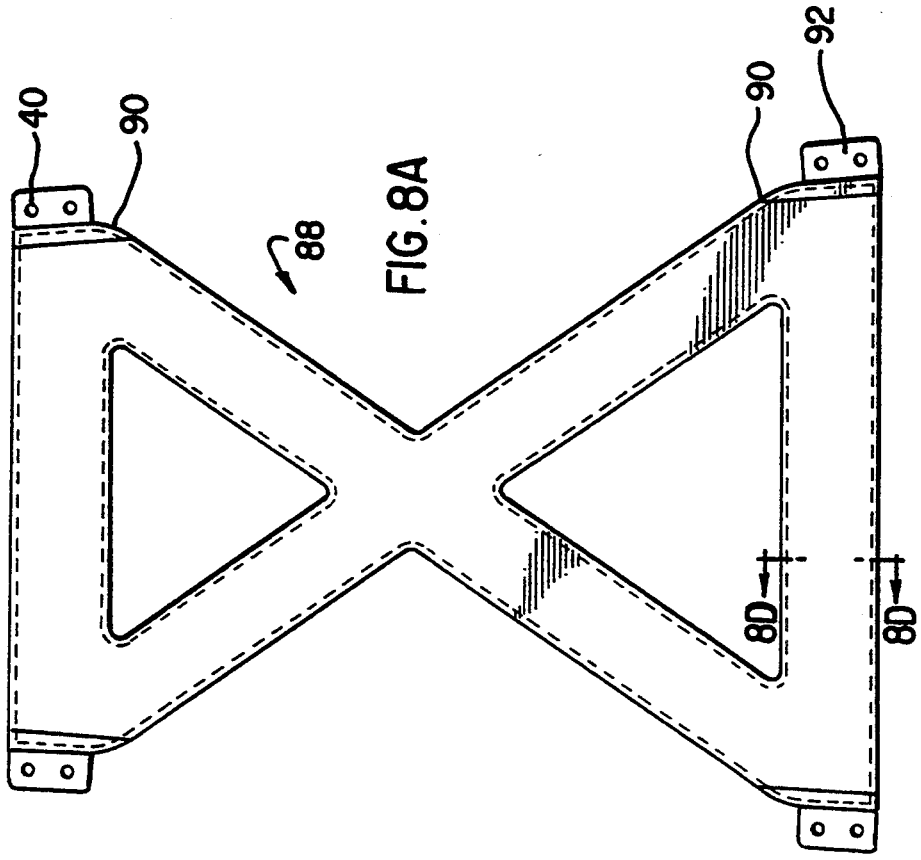
Figure 8B:
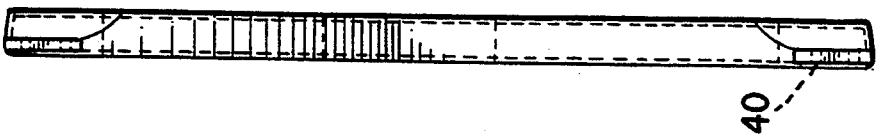
Figure 9C:
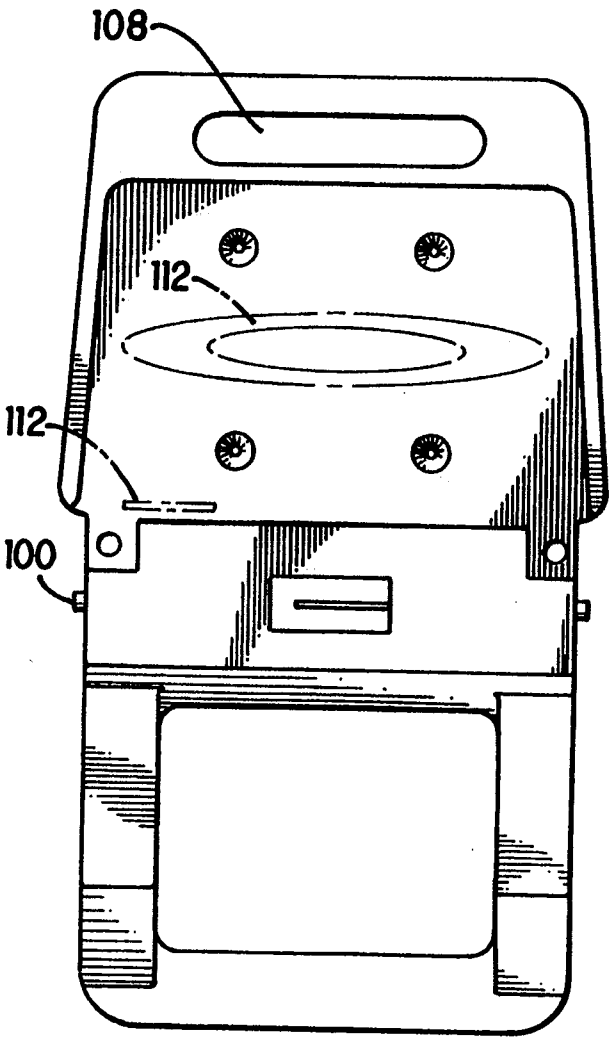
FIGS. 9*a*–9*c* show several views and sections of the blow molded plastic pail shelf.
Figure 9B:
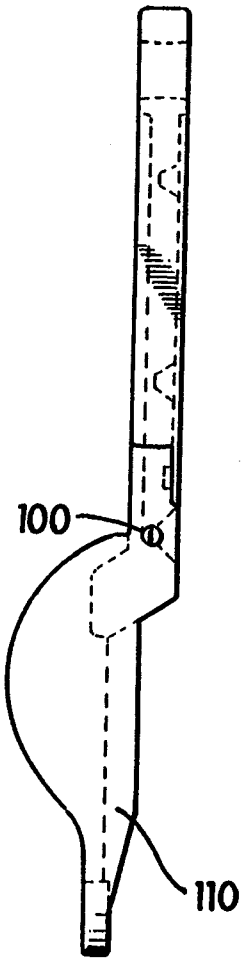
Figure 9A:
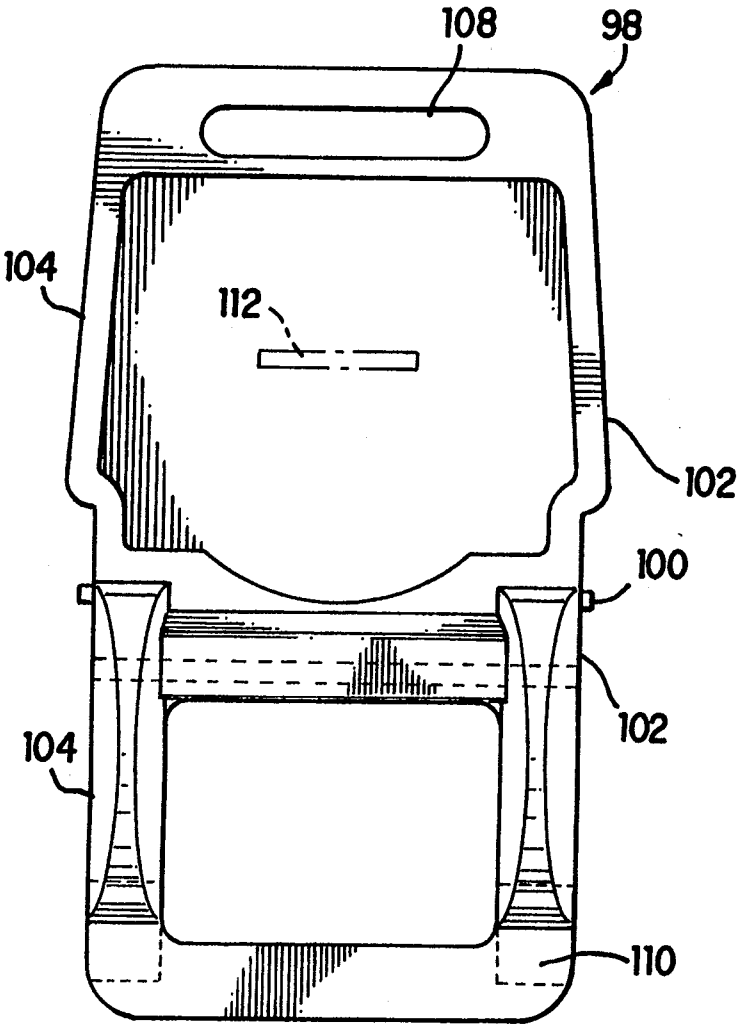

As shown in FIGS. 2*a*–2*f*, left front rail 14 is a hollow plastic member having a substantially u-shaped or c-shaped cross section, which is formed by blow molding. As shown in FIG. 2*b*, FIG. 2*d* shows this u-shaped cross section. Left front rail 14 has various reinforced pockets 22 with pocket holes 24 along its two parallel sides, through which a plurality of steps 26 are connected by convenient fastening means such as screws, rivets or the like. A cross section of the rail 14 through the reinforcement pockets 22 is shown in FIG. 2*e*. Notice in the area of the reinforcement pockets 22, the cross section 17 of the plastic rail 14 is solid for added strength. The solid cross sections 17 are of a greater thickness than solid portions of cross section 19 of the first and second side rails at other than the predetermined positions. The lower portion of left front rail 14 has a plurality of bottom holes 27 through which convenient fastening means are inserted for connection to feet 28 which are adapted to rest directly on the ground or some other suitable support. The upper section of left side rail 14 has a plurality of reinforced top holes 32 through which convenient fastening means are inserted for fixedly connecting the top of left side rail to the top 34. The central portion of left front rail 14 has a single reinforced center hole 36. A cross section of the rail 14 through the reinforced center hole 36 is shown in FIG. *2f*. Center hole 36 can be used to attach a linkage 72 which connects the left front rail 14 to the left rear rail (not shown).

In the preferred embodiment, the steps 26 are of different geometry. FIGS. *3d–3e* show a middle step 38 having a hollow rectangular cross section in the middle of its length and a v-shaped cross section with a plurality of holes 40 at each end. These holes 40 are disposed in a manner which allow a middle step 38 to be connected at appropriate locations on front rails 14 and 16. FIG. *3a* shows a top view of the middle step 38 having a slip resistant tread pattern 50 disposed on it. FIG. *3b* shows a side view of the middle step 38 showing holes 40 at each end. FIG. *3c* shows the middle step 38 along its length. The slip resistant tread pattern 50 is clearly shown. FIG. *3d* shows a cross section of the middle step 38 taken through holes 40. Notice, at least a portion of the middle step 38 is hollow. FIG. *3e* is a cross section through line *3e* (the middle) of the middle step 38 showing the hollow cross section and tread pattern 50.

FIGS. *4a–4e* show various views of a braced step 44 having a hollow rectangular cross section in the middle of its length. When viewed from the front, as shown in FIG. 46, the ends of braced step 44 form triangular braces 46, which have a plurality of holes 40 located at its upper and lower portion and which are disposed in a manner which allow braced step 44 to be connected to appropriate locations on front side rails 14 and 16. Slip resistant tread patterns 50 are molded directly into the top surface of steps 26. FIG. *4a* is a top view of the braced step 44 showing a preferred pattern for the reinforced tread patterns 50. FIG. *4c* is a side view of the braced step 44. FIG. *4d* is a cross section of the braced step 44 through the holes 40. Notice at least a portion of the braced step is hollow. FIG. *4e* is a cross section of the braced step 44 through line *4e* (the middle). The raised tread patterns 50 are clearly shown.

The top 34 of ladder 10 is rotatably connected to rear section 54 which is comprised of two vertically oriented rear side rails, third or left rear rail 56 and fourth or right rear rail 58 which structurally are mirror images of each other. Hence, for convenience of the reader, only the left rear rail 56 will be described. As shown in FIGS. *5a–5e*, left rear rail 56 is a hollow plastic member having a substantially u-shaped cross section which is formed by blow molding. FIG. *5a* shows a side view of the rear rail 56. FIG. *5b* shows a front view of the rear rail 56. FIG. *5c* is a cross section in the middle of the rear rail 56 and shows that the legs of the "u" are of different lengths, the structural leg 62 being the longer. Various reinforced pockets 22 are located at appropriate locations along the length of the structural leg 62, through which a bracing structure 64 is connected by convenient fastening means. FIG. *5d* shows a cross section of the rear rail 56 through a reinforced pocket 22.

The lower portion of left rear rail 56 has a single bottom hole 27 through which a convenient fastening means is inserted for connection to feet 66 which are adapted to rest directly on the ground or some other suitable support.

The center portion of left rear rail 56 has a center hole 36 through which a rear leg 68 of linkage 70 (not shown) is connected by a convenient fastening device. FIG. *5e* shows a cross section of the rear rail through center hole 36. Notice that the area around the center hole 36 is solid for added strength. The front leg 72 of linkage 70 is connected to the center hole 30 on the left front rail of front section 12. Rear leg 68 and front leg 72 are pivotably connected by hinge 74.

In one preferred embodiment, the bracing structure 64 is comprised of several horizontally oriented bracing elements of various geometry. FIGS. *6a–6e* show a hollow plastic center bracing element 80 which is formed by blow molding. FIG. *6a* shows the bracing element 80 from a top view. FIG. *6b* shows the bracing element 80 from a side view. As shown in FIG. *6e*, the middle of center bracing element 80 has a substantially hollow rectangular cross section, while the ends have a reinforced surface 82 with a plurality of holes 40 through which appropriate fastening means are inserted for connection to the left and right rear rails 56 and 58, respectively. FIG. *6d* shows a cross section of the bracing element 80 through the holes 40. Notice that the area around the holes 40 is solid.

FIGS. *7a–7e* show a bracing element 84 which is a hollow plastic member formed by blow molding. As shown in FIG. *5d*, the middle of braced bracing element has a substantially hollow rectangular cross section while the ends, when viewed from the front, form triangular braces 86. FIG. *7a* shows the bracing element from a front view. FIG. *7b* shows the bracing element from a top view. FIG. *7c* shows the bracing element from a side view. A plurality of holes 40 are disposed at the upper and lower portion of triangular braces 86 through which convenient fastening means, such as rivets, screws, fasteners, or the like, are inserted for connection to the rear side rails 56 and 58. A cross sectional view of the triangular brace taken through line *7e* as shown in FIG. *7e*.

In another preferred embodiment and as best shown in FIGS. *8a–8d*, the bracing structure 64 is a single plastic x-shaped brace 88 with two close ends and is formed by blow molding. FIG. *8a* shows a front view of the brace 88. FIG. *8b* shows a side view of the brace 88. FIG. *8c* shows a top view of the brace 88. The center sections of x-shaped brace 88 have substantially hollow plastic cross sections. FIG. *8d* is a cross section of the brace 88 taken through line *8d* showing the hollow structure. While the four corners 90 have flat surfaces 92 with a plurality of holes 40 through which convenient fastening means are inserted for connection to left and right rear rails 56 and 58, respectively.

In a preferred embodiment, the rear section 54 is equipped with a plastic pail shelf 98, as shown in FIG. *9a–9c*, which has a hollow plastic structure formed by blow molding. FIG. *9a* is a top view of the shelf 98 showing the surface upon which a paint bucket would rest. FIG. *9b* is a side view of the shelf 98. FIG. *9c* is a bottom view of the shelf 98. The pail shelf 98 is disposed such that any weight placed thereupon is distributed across the full area of the pail shelf. The pail shelf 98 is connected to rear section 54 by nibs 100 which are located on the center of edges 102 and 104 and are rotatably connected to the bracing structure 64. Pail shelf 98 has a handle 108 on one end and a strut 110 on the other. It should be appreciated that graphics 112 such as direction, warnings, decoration, logos, etc. can be molded directly into appropriate members of the ladder 10. In this way, the pail shelf 98 does not need any additional attachments in order to attach it on the ladder 10. The strut 110 is preferably shaped like a cam so that it contacts a cross beam, such as bracing element 84, to automatically pivot the pail shelf 98 as the ladder is folded into an inoperable position.

Figure 10:
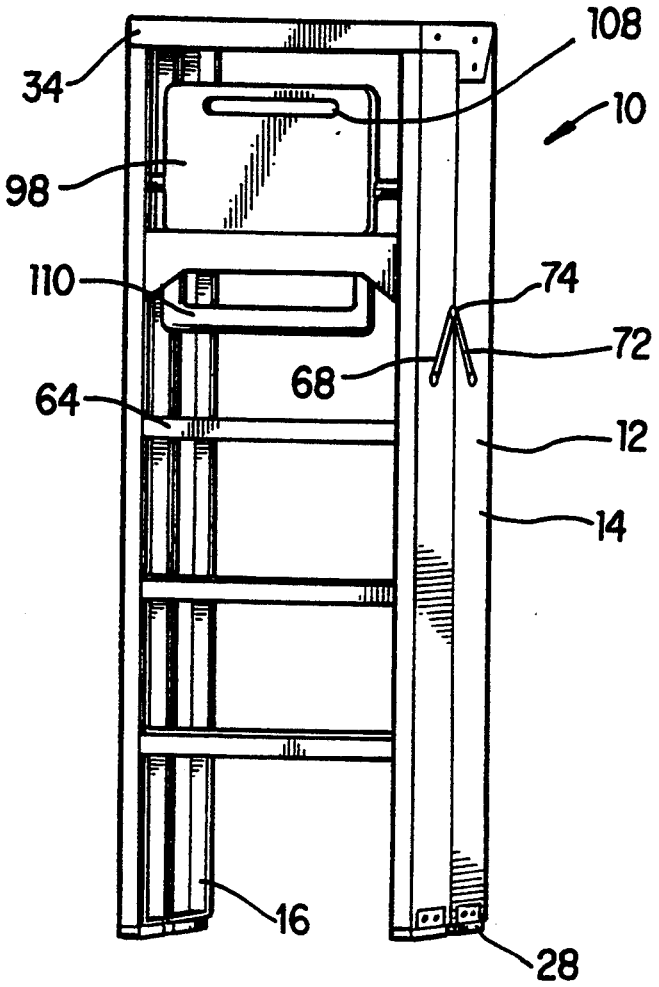
FIG. 10 is a schematic representation showing the ladder and its parts in the folded position.

While not in use, the ladder normally occupies a position shown in FIG. 10. Rear section 54. which is rotatably connected to top 34 lies flat against front section 12, while linkage 70 is folded into a v-shape. When the ladder is to be used, rear section 54 and front section 12 are pulled away from each other until the linkage becomes straight, thus, inhibiting further movement. The pail shelf can be rotated until the strut 110 comes in contact with the bottom surface of the top step 26 of front section 12, thus forming a horizontally oriented weight bearing surface on which an object such as a pail or paint bucket can rest.

The user can now ascend the ladder by climbing the steps 26 of front section 12. Tread patterns on steps 26 provide a safe slip resistant surface. Graphics 12 located at appropriate locations of ladder 10 can be seen and read by the user for warnings and directions. When the user is done using the ladder 10, the strut 110 of pail shelf 98 is rotated away from the bottom surface of the top step 26 by simply closing the ladder 10 into an undeployed configuration. When the ladder 10 is in an undeployed configuration the pail shelf 98 is maintained in a stationary or static position. The front and rear sections 12 and 14 of ladder 10 can be folded towards each other by first pushing upwards on pivot 74 of linkage 70. Thus, breaking the linearity of legs 68 and 72.

Figure 11:
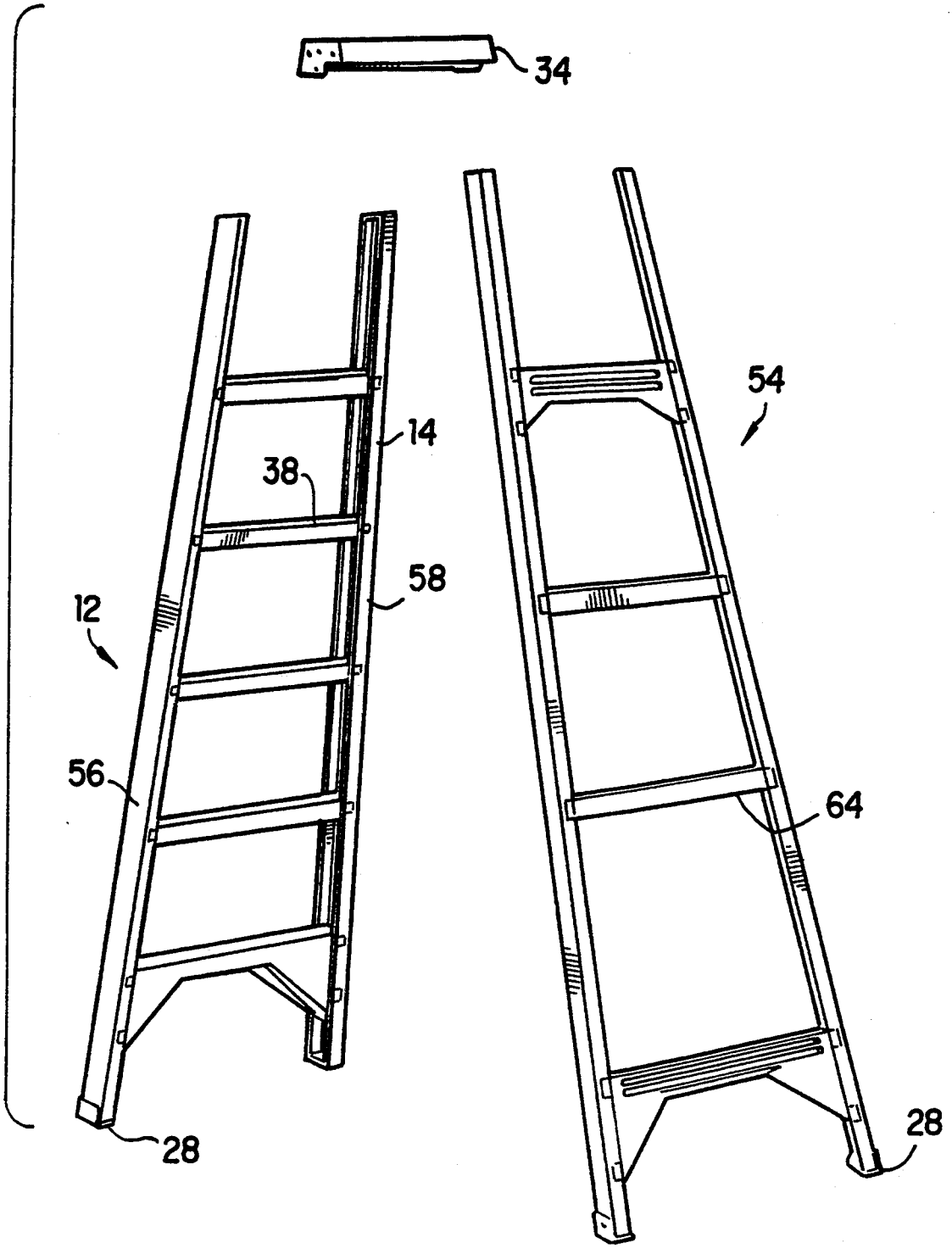
FIG. 11 is a schematic representation of an alternative embodiment of a plastic ladder.

In an alternative embodiment, the front section and rear section are each one continuous piece of plastic. That is, the steps, the bracing and the rails as well as the feet are one continuous piece of plastic. Similarly, the rear section, comprised of the rails, the bracing elements and the feet are one continuous piece of plastic, as shown in FIG. 11.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A plastic ladder comprising:

a first plastic side rail, at least a portion of which is hollow;

a second plastic side rail, at least a portion of which is hollow, said second side rail in parallel with the first side rail;

a plurality of steps, each of which is attached to the first and second rails at predetermined locations such that each step forms a flat weight bearing platform upon which a user can stand; and wherein the first and second rails each have a plurality of pockets having solid cross sections disposed therealong at predetermined positions, and each of said steps are attached to the first and second rails at corresponding pockets therein with fasteners through holes in the solid cross sections.

2. A plastic ladder as described in claim 1 wherein the solid cross sections are of a greater thickness than solid portions of cross sections of the first and second rails at other than the predetermined positions.

3. A plastic ladder as described in claim 2 wherein the first and second rails and the steps define a front section; and including a third side rail and a fourth side rail disposed essentially in parallel with the third side rail;

a plurality of bracing elements, each of which are attached to the third and fourth side rails to support the third and fourth side rails, said third and fourth side rails and said bracing elements define a rear section; and a top which is connected to the front and rear sections at the top ends of the first and second rails, and the top ends of the third and fourth rails such that the front and rear sections form a v-shape when deployed and fold on top of each other when undeployed.

4. A plastic ladder as described in claim 3 wherein the ends of the first and second side rails are fixedly connected to the top, and the ends of the third and fourth side rails are rotatably connected to the top.

5. A plastic ladder as described in claim 4 including a first linkage and a second linkage connecting the first and third side rails, and second and fourth side rails, respectively, such that when the front and rear sections are deployed, the linkages securely maintain the v-shape that is formed thereby; and when the front and rear sections are undeployed, the linkages fold.

6. A plastic ladder as described in claim 5 wherein each side rail has a cross section which is essentially in the shape of a C.

7. A plastic ladder as described in claim 6 wherein the top, the third and fourth side rails, and the bracing elements are made of plastic.

8. A plastic ladder as described in claim 7 wherein the top, the first, second, third and fourth side rails, and the bracing elements are blow molded.

* * * * *